US012291868B2

(12) United States Patent
Chiu et al.

(10) Patent No.: US 12,291,868 B2
(45) Date of Patent: May 6, 2025

(54) RETROFITTING METHOD FOR A BEAM WITH AN OPENING

(71) Applicant: NATIONAL TAIWAN UNIVERSITY OF SCIENCE AND TECHNOLOGY, Taipei (TW)

(72) Inventors: Chien-Kuo Chiu, Taipei (TW); Min-Yuan Cheng, Taipei (TW); Chieh-Tzu Chou, Taipei (TW)

(73) Assignee: NATIONAL TAIWAN UNIVERSITY OF SCIENCE AND TECHNOLOGY, Taipei (TW)

( * ) Notice: Subject to any disclaimer, the term of this patent is extended or adjusted under 35 U.S.C. 154(b) by 195 days.

(21) Appl. No.: 17/900,178

(22) Filed: Aug. 31, 2022

(65) Prior Publication Data

US 2023/0349156 A1 Nov. 2, 2023

(30) Foreign Application Priority Data

Apr. 28, 2022 (TW) ..... 111116306

(51) Int. Cl.
*E04C 3/34* (2006.01)
*E04C 5/06* (2006.01)

(52) U.S. Cl.
CPC ..... *E04C 5/0618* (2013.01); *E04C 3/34* (2013.01)

(58) Field of Classification Search
CPC ..... E04C 3/293; E04C 5/0604; E04C 3/145; E04C 5/0618; E04C 3/34; E04B 1/215; E04B 5/48
See application file for complete search history.

(56) References Cited

U.S. PATENT DOCUMENTS 3,475,876 A * 11/1969 Oroschakoff ..... E04C 5/0622 52/669
5,119,614 A * 6/1992 Rex ..... E04C 3/34 52/649.3
6,158,189 A * 12/2000 Lau ..... E04C 3/145 52/693
7,293,394 B2 * 11/2007 Davis ..... E04C 3/18 52/650.1
7,934,347 B2 * 5/2011 Brienen ..... E04B 1/34 52/587.1
8,863,445 B2 * 10/2014 Zhong ..... E04B 1/34823 52/79.14
9,404,249 B2 * 8/2016 Langone ..... E04B 1/30
10,519,657 B1 * 12/2019 Callahan ..... E04C 3/145
10,934,734 B1 * 3/2021 Al-Salloum ..... E04H 9/04
12,049,760 B2 * 7/2024 Draheim ..... E04C 3/08

FOREIGN PATENT DOCUMENTS

CN 113719031 * 11/2021

* cited by examiner

*Primary Examiner* — Brian E Glessner
*Assistant Examiner* — Daniel J Kenny
(74) *Attorney, Agent, or Firm* — BACON & THOMAS, PLLC

(57) ABSTRACT

A retrofitting method for a beam with an opening is disclosed. The retrofitting method provides a hoop cooperated with an inclined stirrup to form a reinforcement set. The hoop is used to enclose the opening; and the reinforcement set may be selectively adjusted according to the distance between the edge of opening and a column face. The retrofitting method and reinforcement set are not only suitable for openings located in the non-plastic hinge zone of the beam, but also suitable for the openings located in the plastic hinge zone.

20 Claims, 11 Drawing Sheets

FIG. 1 (Prior Air)

FIG. 2 (Prior Air)

FIG. 3 (Prior Air)

RETROFITTING METHOD FOR A BEAM WITH AN OPENING

BACKGROUND OF THE INVENTION

(1) Field of the Invention

The present invention relates to a reinforcement method of beam, in particular to a method for retrofitting a reinforced concrete (RC) beam with an transverse opening.

(2) Description of the Prior Art

A construction project can be roughly divided into three major parts, namely structural works, electrical and mechanical works, and decoration works. In the process of contracting out, the owner generally signs a single contract with a construction firm and let the construction firm make an overall is construction plan to integrate the structural works with the electrical and mechanical works. For example, the construction firm executing the integration works may produce structural electrical and mechanical (SEM) drawings, which show details of openings, bases, sleeves, embedded parts or piping for electrical and mechanical facilities for reference in safety analysis and further design. However, the use and appearance of buildings today are quite different from those in the past; moreover, the electrical and mechanical works and the decoration works are more complex, so the owner changes the policy of contracting out and signs separate contracts with multiple construction firms. Because these construction firms have a parallel relationship, their construction drawings and designs are examined independently, leading to conflicts during construction. The conflicts may even lead to the integration failure of structural, electrical, mechanical and decoration works.

For a building that uses moment-resisting frames as the gravity and seismic systems, the beam member is designed with sufficient flexural strength, shear strength and stiffness to transfer the load from the floor to the column member. The transverse opening reserved for pipes or ducts, however, reduce the strength and stiffness of the beam. Existing researches have shown that shear strength of perforated beam members is greatly reduced, and two shear failure modes are prone to occur, including: (a) beam-type failure as shown in FIG. 1, a single crack extending through the entire beam depth; (b) frame-type failure as shown in FIG. 2, which takes place when two distinct cracks form in the top and bottom chords, and one of the chords fails due to this cracking.

According to the current guidelines of construction drawings, the edge of the openings need to be located at a distance at least twice the beam depth from the face of the support column (also known as the "non-plastic hinge zone"), and the supplementary reinforcement is needed around the openings. It is not recommended to make openings at the beam ends within a length at least twice the beam depth from the support column (also known as the "plastic hinge zone") where inelastic behavior is expected during an earthquake.

Traditionally, to limit the influence of openings on the beam strength and stiffness, supplementary reinforcement shown in FIG. 3 is required around the opening, and the edge of openings must be located outside the plastic hinge zone. The supplementary reinforcement includes upper section close ties 11, lower section close ties 12, supporting longitudinal bars 13, full section close ties 14, and Z-shaped diagonal bars 15. Each of the upper right part, lower right part, upper left part and lower left part in the periphery of the opening should be reinforced with a pair of Z-shaped diagonal bar 15. Obviously, the required supplementary reinforcement is difficult to construct.

Driven by economic and practical needs, openings in the plastic hinge zone of the beam became increasingly preferred in recent years. To meet the needs, it is necessary to develop a relatively easy retrofit method for beams with transverse openings in the plastic hinge zone.

SUMMARY OF THE INVENTION

One objective of the present invention is to provide a retrofitting method for a beam with an opening located in the plastic hinge zone or non-plastic hinge zone, and to prevent the perforated beam from undergoing the undesired failure under the action of strong earthquakes.

Another objective of the present invention is to provide a retrofitting is method for a beam with an opening by using a simpler reinforcement set than the traditional supplementary reinforcement.

In order to achieve the aforementioned objectives, the present invention provides a retrofitting method for a beam with an opening. The retrofitting method comprises steps of: evenly moving the closed hoops intercepted by the opening to the left and right sides of the opening; providing a hoop, such as a double-square hoop, to enclose the opening; providing an inclined stirrup, such as an inclined U-shaped stirrup, for being cooperated with the hoop to form a reinforcement set; and selectively adjusting the reinforcement set according to a location of the opening.

In an embodiment, the above-mentioned adjusting the reinforcement set comprises steps of: dividing the beam into a plurality of regions based on the distance away from the column face, and adjusting the reinforcement set according to distance between the edge of the opening and the column face. The quantity of the inclined U-shaped stirrup is reduced as the edge of the opening is located farther from the column face. For example, the quantity of the inclined U-shaped stirrup may be reduced to zero in non-plastic hinge zone.

In an embodiment, the above-mentioned dividing the beam into the plurality of regions comprises steps of: determining a plurality of boundaries between the plurality of regions according to a specific length extending from the column face toward a mid-span of the beam.

In an embodiment, the above-mentioned method further comprising: determining an inclined angle of the inclined U-shaped stirrup according to a ratio between the beam depth and a diameter of the opening, and to maintain a clear cover to the edge of the opening.

In an embodiment, the beam comprises a plurality of longitudinal bars and the inclined U-shaped stirrup is provided with its corner to enclose the longitudinal bars, and the above-mentioned adjusting the reinforcement set comprises step of: adjusting the inclined U-shaped stirrup according to the distance between the edge of the opening and the column face.

In an embodiment, the above-mentioned adjusting the reinforcement set comprises step of: reducing the quantity of the inclined U-shaped stirrups for the opening with its edge located in the regions farther away from the column face.

In an embodiment, the above-mentioned method provides a hoop having at least one hoop unit, and provides an inclined U-shaped stirrup cooperated with the hoop. The hoop unit includes an outer hoop and an inner hoop, wherein the inner hoop is located in the area enclosed by the outer hoop. The shape of the outer hoop is selected from a group consisting of circle, square and hexagon. And the shape of the inner hoop is selected from a group consisting of circle, square, rhombus and hexagon. When selecting squares to be the shapes of both the outer hoop and the inner hoop, the four sides of the inner hoop cooperate with four corners of the outer hoop to form four triangular regions, respectively. The inclined U-shaped stirrup is provided to enclose the beam top and bottom longitudinal bars. The legs of the U-shaped stirrup need to pass through the beam depth with an inclined angle in order to maintain a minimum clear cover to the edges of the opening.

To sum up, the retrofitting method of the present invention employs hoops cooperated with inclined U-shaped stirrups to form a reinforcement set for retrofitting a beam with openings, and adjusts the quantity of inclined U-shape stirrups according to the distance between the edge of opening and column face. Compared with the traditional supplementary reinforcement, the is reinforcement set of the present invention is obviously simple and easy to adjust in structure.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure(s) being described. The components of the present invention can be placed in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Accordingly, the drawings and descriptions will be regarded as illustrative in nature and not as restrictive.

Figure 1:
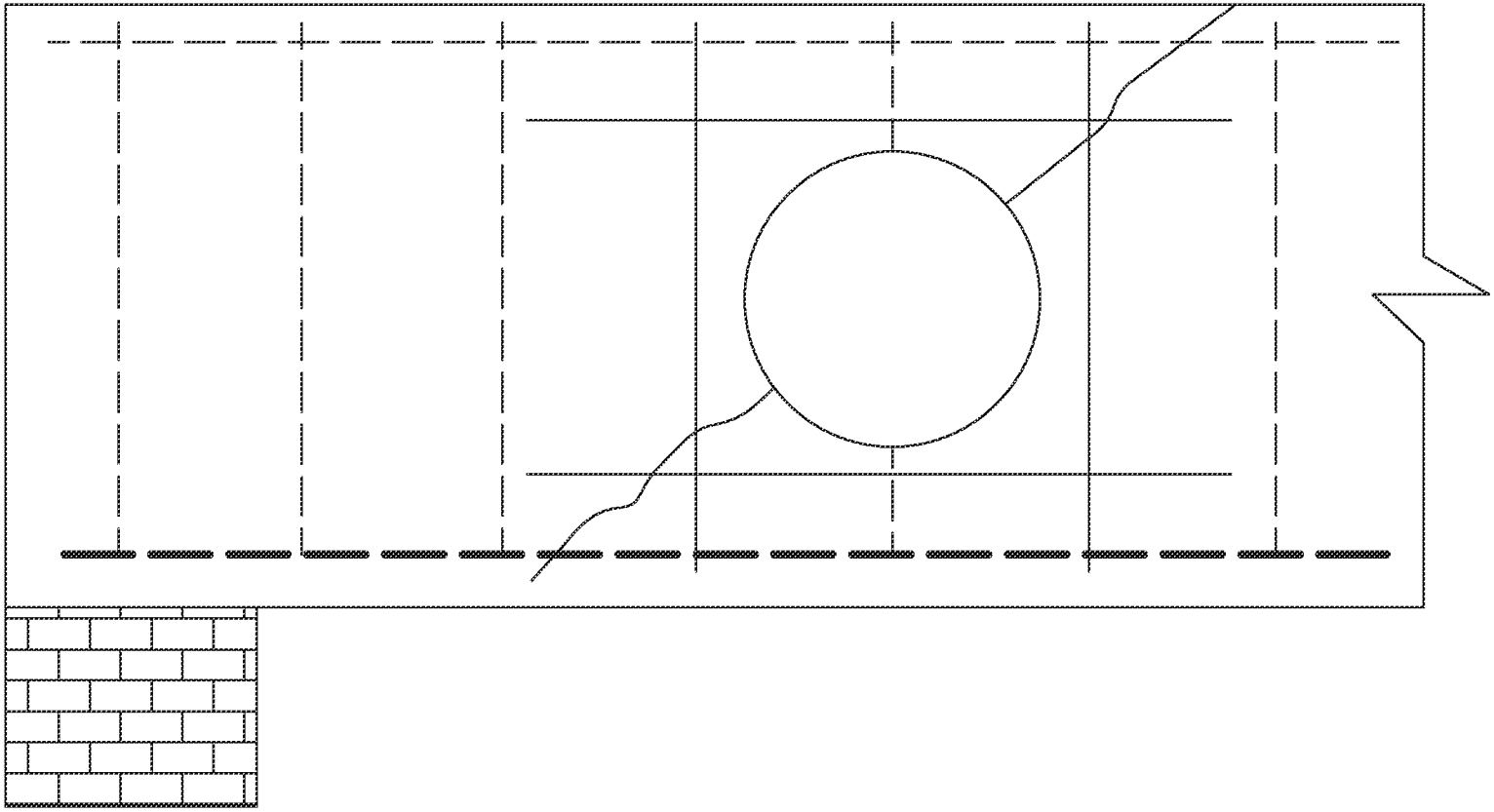
FIG. 1 is a schematic diagram of beam-type failure mode.
Figure 2:
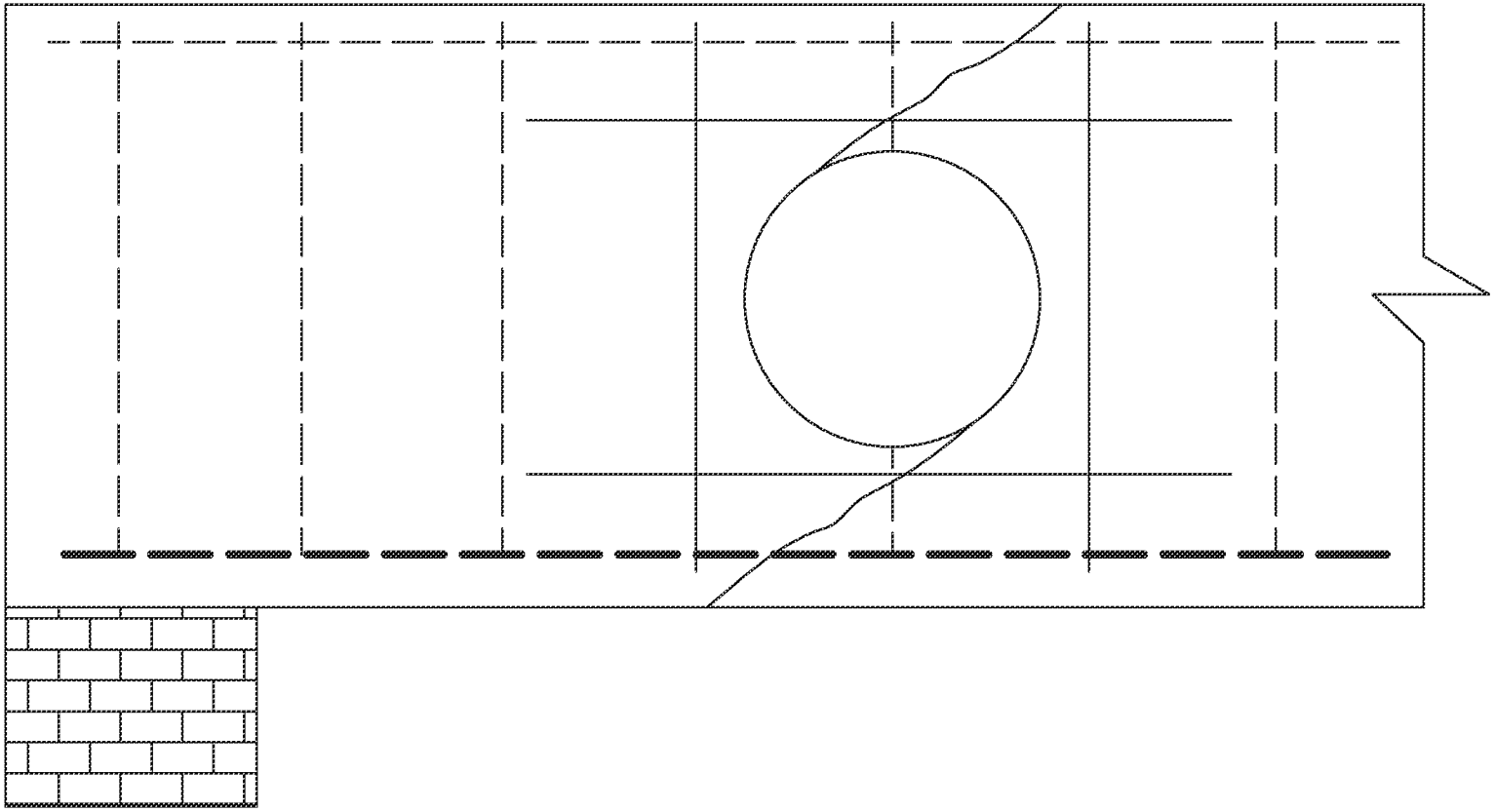
FIG. 2 is a schematic diagram of frame-type failure mode.
Figure 3:
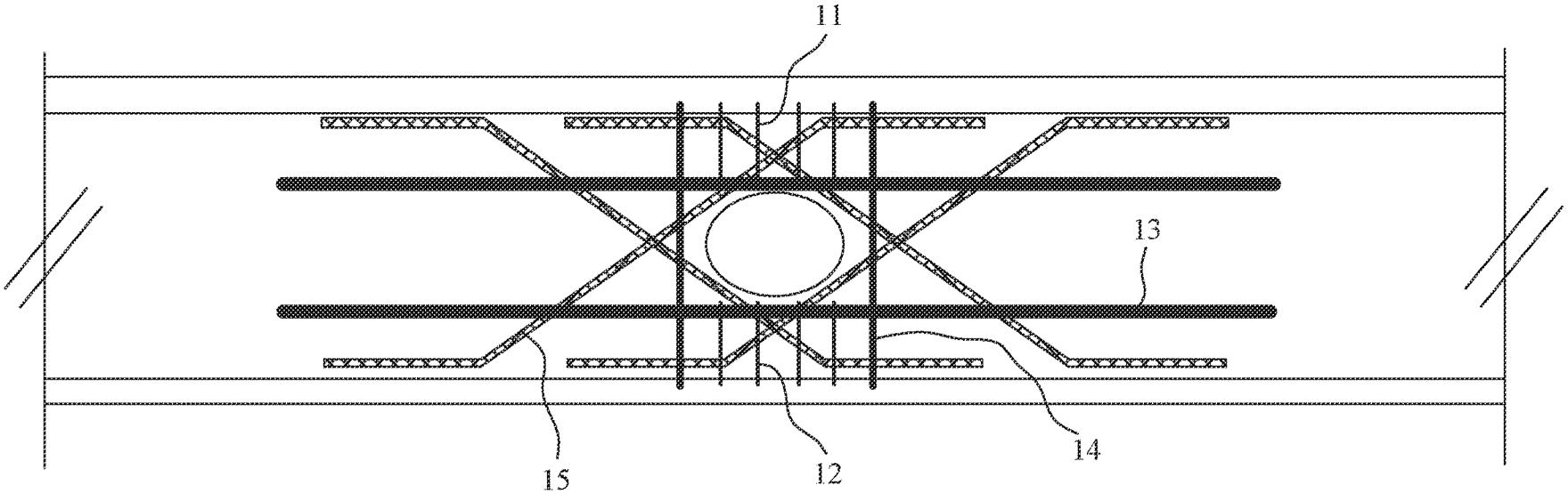
FIG. 3 is a schematic diagram of traditional supplementary reinforcement.
Figure 4:
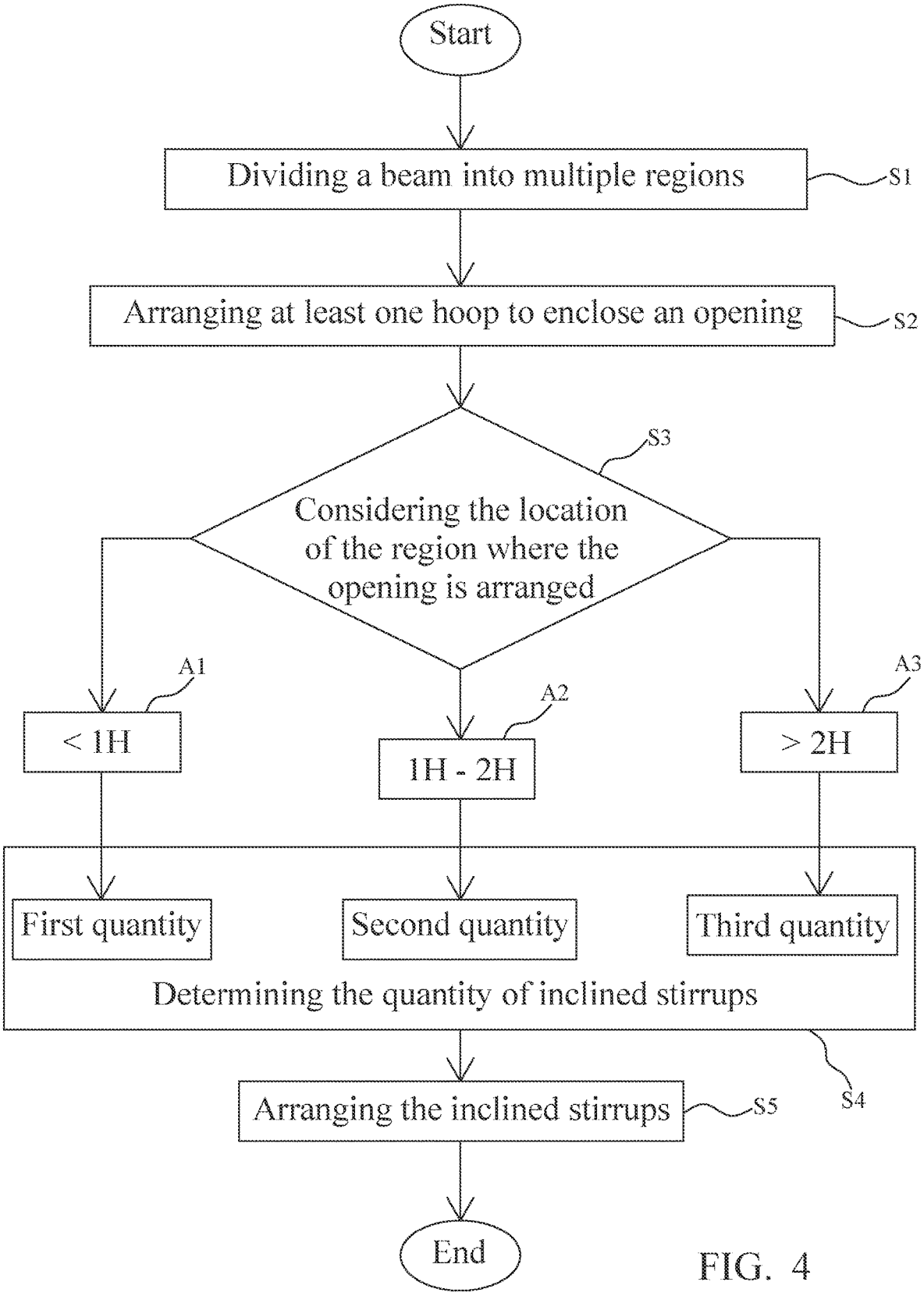
FIG. 4 is a schematic diagram of the retrofitting method for a RC beam with a transverse opening according to an embodiment of the present invention.

FIG. 4 is a schematic flowchart diagram of the retrofitting method for a RC beam with an opening according to an embodiment of the present invention. In the embodiment, the beam is firstly divided into multiple regions according to the magnitude of the bending moment induced by the lateral load such as earthquake or wind (S1). Typically, the farther away a position at the beam is from a support column, the smaller bending moment the position bears under lateral load. Then, different reinforcement sets are provided for a beam with the openings located in different regions, wherein the openings referred to those completely passing though the beam transversely, or not completely passing though the beam transversely (blind holes). The reinforcement set comprises a hoop and an inclined stirrup cooperated with the hoop. In an embodiment, the hoop of the reinforcement set comprises a double-square hoop, and the inclined stirrup comprises an inclined U-shaped stirrup. Next, the hoop is arranged to enclose the opening (S2), to prevent potential failures as shown in FIG. 1 or FIG. 2. Also referring to FIG. 5, the quantity of the inclined U-shaped stirrups and hoops is determined based on the location of the edge of opening (S3, S4). A smaller quantity of the inclined stirrup and the hoop may be sufficient for beams with the edge of openings in the regions where inelastic bending behavior is not expected. For example, the bending moment demand on region A3 is typically smaller than that on region A2 when the moment-resisting frame is subjected to lateral load, so the quantity (shown as the block "Third quantity" in FIG. 4) of the inclined U-shaped stirrups required in region A3 may be smaller than that (shown as the block "Second quantity" in FIG. 4) in the region A2. Regions A1 is expected to experience large inelastic flexural response, the required quantity (shown as the block "First quantity" in FIG. 4) of the inclined U-shaped stirrups in region A1 is the largest. After the quantity of the inclined U-shaped stirrups is determined, arrange the inclined U-shaped stirrups (S5). In the process of arranging the inclined U-shaped stirrups (S5), it is necessary to further consider the inclined angle of the U-shaped stirrups and its quantity.

Figure 5:
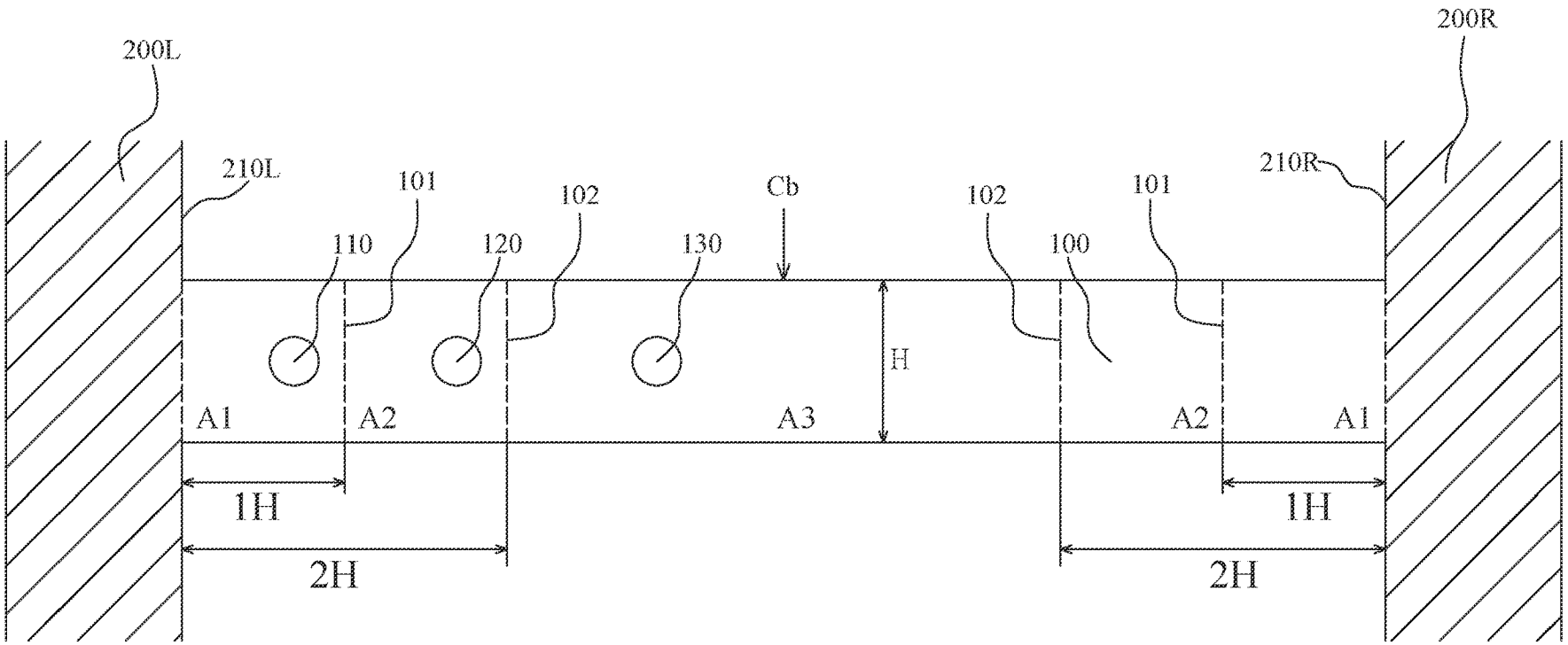
FIG. 5 is a schematic diagram showing the regions of the beam defined according to an embodiment of the present invention.

As shown in FIG. 5, two ends of the beam 100 are respectively connected to two support columns 200L, 200R. In one embodiment, the beam 100 is divided into three regions. Region A1 is bounded by the column face and the beam section 101 located at a distance of one beam depth (1H) away from the column faces 210L, 210R. Region A2 is bounded by the beam sections 101, 102 located at a distance of one beam depth (1H) and two beam depth (2H) away from the column faces 210L, 210R. The rest of the beam portion toward the mid-span Cb of the beam 100 is defined as region A3. From one point of view, the present invention determines the boundaries between the regions A1, A2 and A3 according to a specific length extending from the column faces 210L, 210R toward the mid-span Cb of the beam 100 as well as a range of ratio of the specific length to the beam depth H. Practically, "plastic hinge zone" where inelastic flexural response is expected during an earthquake is generally defined within a 2H distance from the beam ends or column faces 210L, 210R. Therefore, regions A1 and A2 in the embodiment are located in the plastic hinge zone, but region A3 belongs to the non-plastic hinge zone. In an embodiment, each of the regions A1, A2 and A3 may be subdivided.

From another point of view, the region A1 is connected with the support column 200L (or 200R), so the shortest distance between the region A1 and the column face 210L (or 210R) is zero. Similarly, the shortest distance between the region A2 and the column face 210L (or 210R) is one beam depth (1H); the shortest distance between the region A3 and the column is face 210L (or 210R) is two beam depth (2H). The region A2 is located between the region A1 and the region A3. The mid-span Cb of the beam 100 falls in region A3. The present invention determines the quantity of the inclined U-shaped stirrup based on the region where the edge of the opening is located at. When the edge of the opening is located on the boundary of the two regions, the stringent one controls.

FIG. 5 shows an opening 110 in region A1, an opening 120 in region A2, and an opening 130 in region A3. The reinforcement sets for the three openings 110, 120 and 130 are described below respectively.

Figure 6:
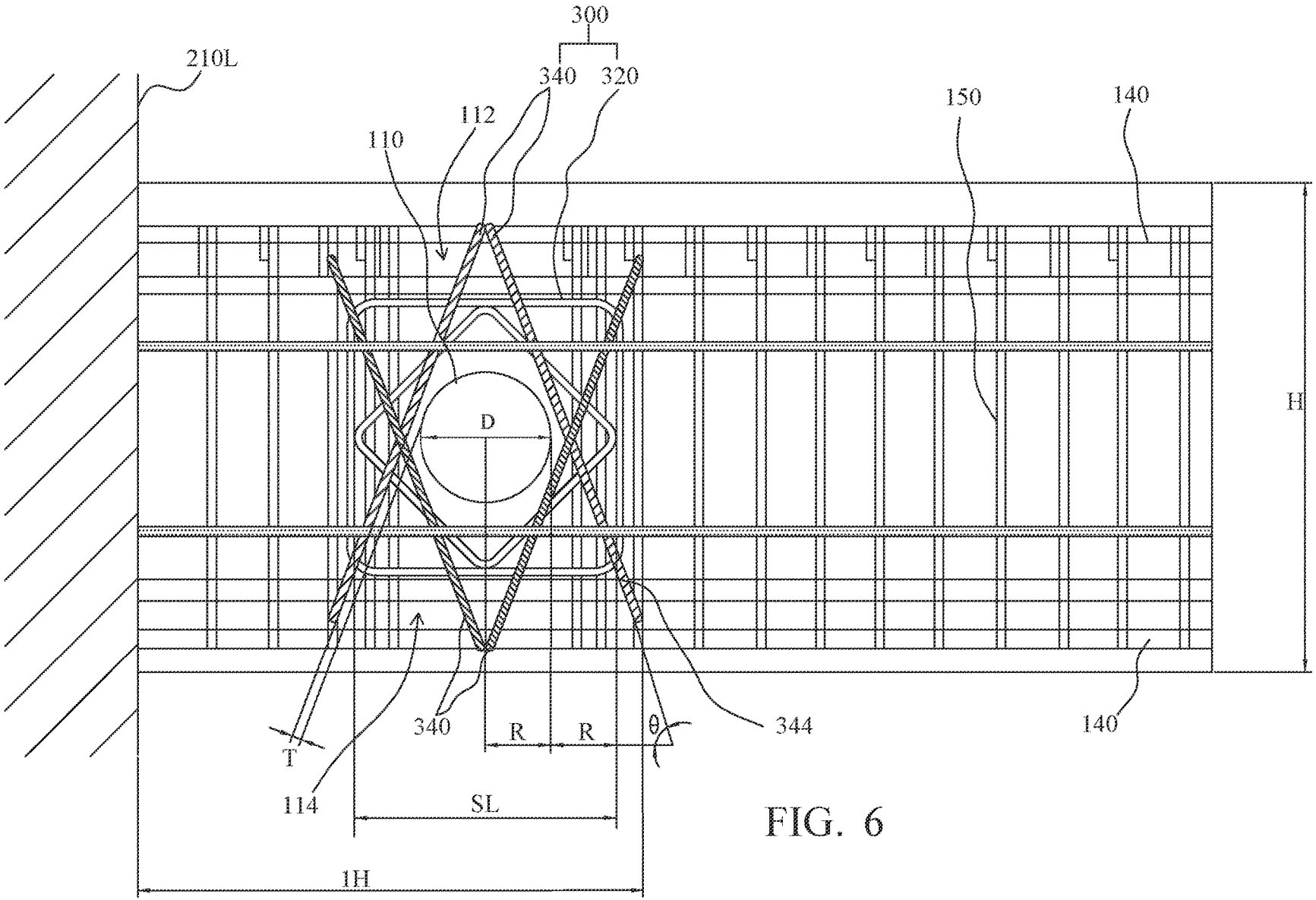
FIG. 6 is a schematic side view showing a reinforcement set for an opening with its edge located at a distance between half and one beam depth from the column face.
Figure 10:
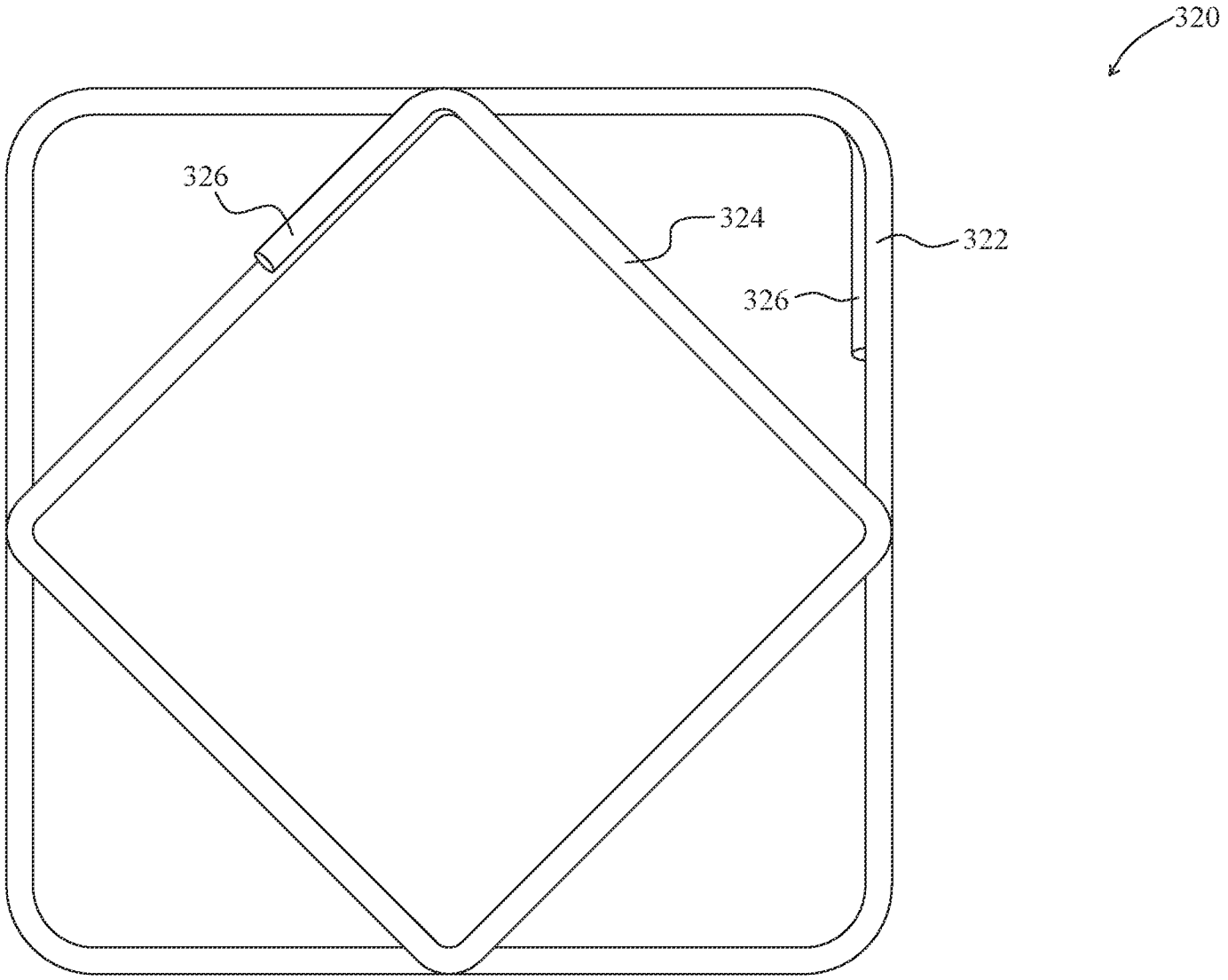
FIG. 10 is a schematic diagram of a double-square hoop according to an embodiment of the present invention.

FIG. 6 is a schematic side view showing a reinforcement set for retrofitting the opening 110 with its edge located between half and one beam depth from the column face 210L. For the opening 110 located in region A1 as shown in FIG. 5, two double-square hoops 320 shown in FIG. 10 are provided first to enclose the opening 110. The opening 110 extends through a virtual plane enclosed by either of the double-square hoops, and the extension direction of the opening 110 is substantially perpendicularly the virtual plane. Thus, the double-square hoops 320 can reinforce a peripheral area that extends outward for a certain distance from the wall of the opening 110. It can be understood that the peripheral area is roughly divided into an upper part 112 located above the opening 110, a lower part 114 located below the opening 110, and two side parts (not numbered) respectively located near the left and right sides of the opening 110. Multiple inclined U-shaped stirrups 340 are provided to retrofit the upper part 112 and the lower part 114. As shown in FIG. 6, the inclined U-shaped stirrup 340 with an inclined angle θ is inserted downward from the upper part 112 to the lower part 114 or inserted upward from the lower part 114 to the upper part 112. Closed hoops 150 originally provided with a regular spacing but intercepted by the opening are evenly moved to the left and right sides of the opening.

Figure 7:
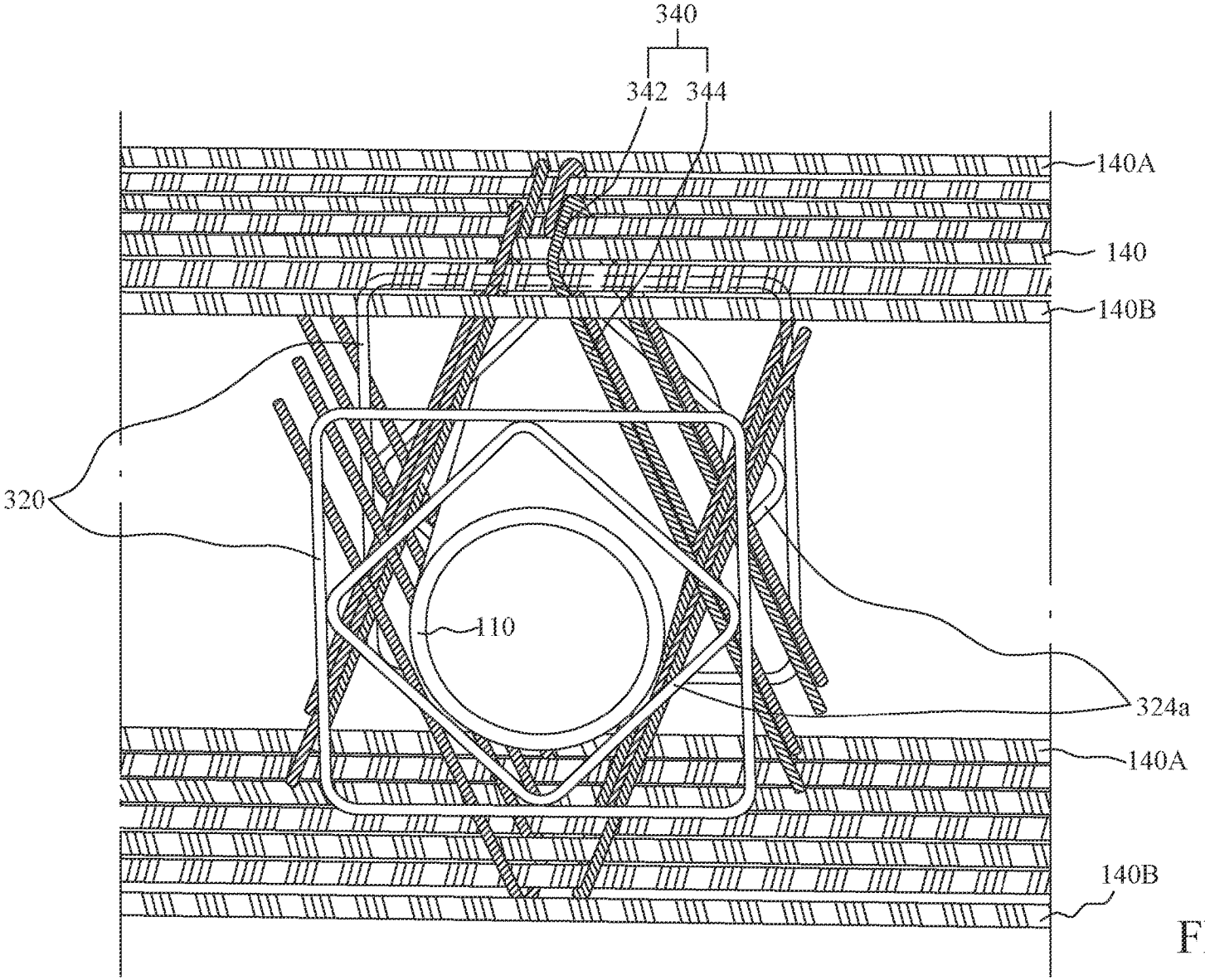
FIG. 7 is a schematic perspective view of the reinforcement set as shown in FIG. 6.

FIG. 7 is a schematic perspective view showing the reinforcement set 300 for the opening 110 in FIG. 6. One skilled in the art can understand that regular closed hoops 150 shown in FIG. 6 are omitted in FIG. 7 to give more prominence to the reinforcement set 300. In practice, the double-square hoop 320 and the inclined U-shaped stirrups 340 are generally tied together with these regular closed hoops 150. Therefore, the configuration of the regular closed hoops 150 may need to be adjusted in accordance with the reinforcement set 300 of the present invention as well as the relevant design criteria of the building codes. For an opening with its edge located between 0.5H and 1H in the region A1, the inclined U-shaped stirrups 340 are placed to enclose the outmost longitudinal bar. A pair of double-square hoops 320 are respectively disposed to enclose the front and rear parts of each opening 110. The double-square hoops 320 are positioned close to the plane formed by the corner of the longitudinal bars on each side of the beam (side plane formed by 140A and side plane formed by 140B).

As shown in FIG. 7, each of the inclined U-shaped stirrups 340 tied on the longitudinal bar 140 has one transverse segment 342 and two inclined segments (also known as "legs") 344. The three segments define an inclined plane. An angle formed between the inclined plane and the upper face or the lower face of the beam 100 is referred to as an inclined angle θ (shown as FIG. 6) of the inclined U-shaped stirrup 340. FIG. 7 shows the first quantity of inclined U-shaped stirrups 340 arranged between the front and rear double-square hoops 320 in region A1. Each of the double-square hoops 320 has an inner rhombus (hereinafter also referred to as "inner square") with four straight sides 324*a* (FIG. 10). The first quantity of inclined U-shaped stirrups 340 can be determined based on the relevant building code requirements or research design recommendations. For the opening 110 located between half beam depth (0.5H) and one beam depth H (1H) from the column face 210L, test results from cyclic loading show that using the sufficient inclined U-shaped stirrups 340 to cooperate with the double-square hoops 320 to retrofit the beam 100 with the openings 110 in region A1 can make the perforated beam 100 achieve the performance equivalent to the beam 100 unperforated in region A1.

Referring to FIG. 6 again, for the design of the opening 110 and its reinforcement set 300, the diameter D of the opening 110 less than one third of the beam depth H may be required when the beam depth H is known. At least twice the diameter D of the opening 110 is adopted as a side length SL of the double-square hoop 320, so that the double-square hoop 320 can reinforce the peripheral area extending outward for a distance of one radius R outside the edge of opening 110. The inclined angle θ of the inclined U-shaped stirrups 340 may be determined according to a ratio between the beam depth H and the diameter D. The legs 344 of the U-shaped stirrups 340 pass through the beam depth H with the inclined angle θ in order to maintain a clear cover T to the edges of the opening.

Figure 8:
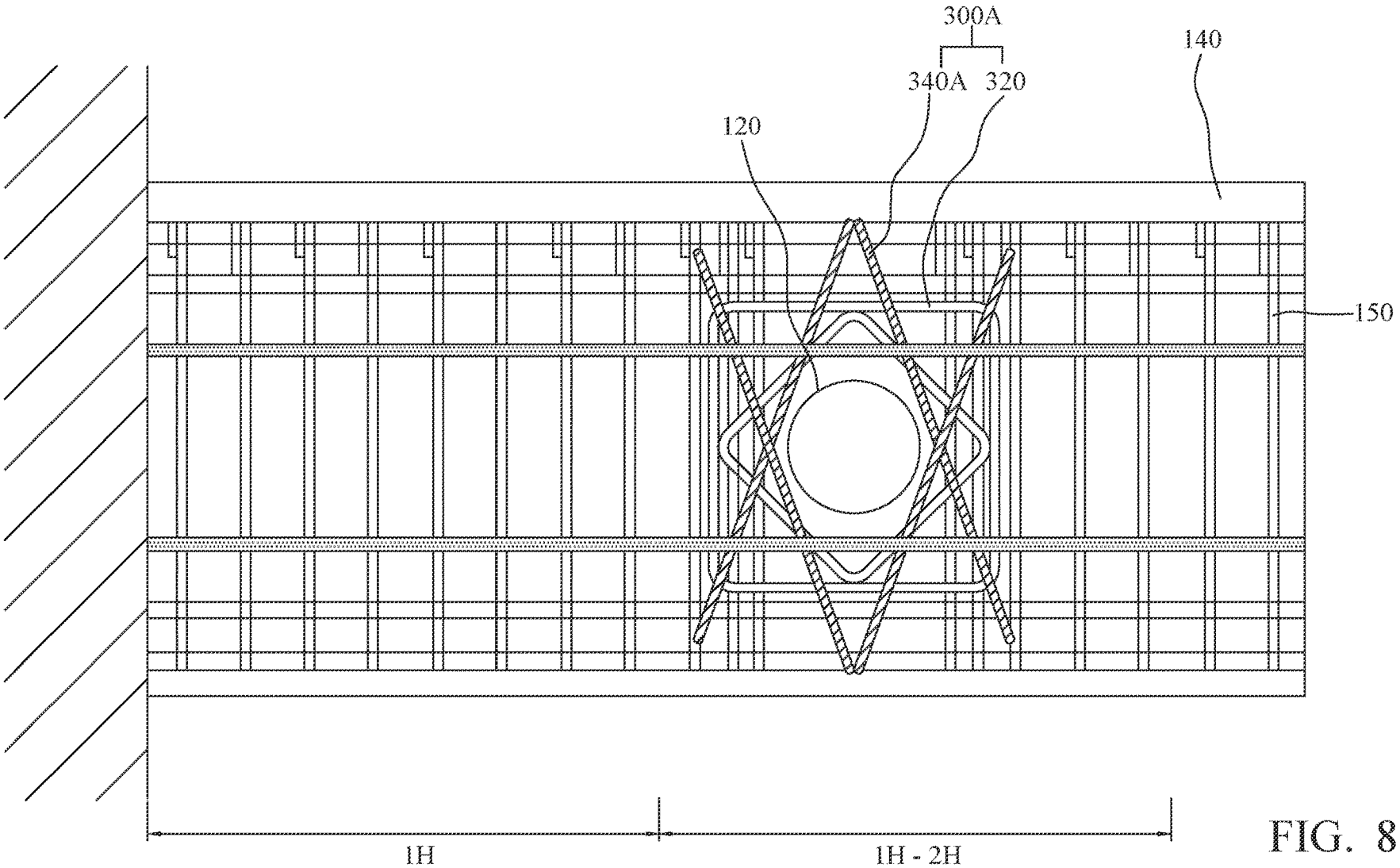
FIG. 8 is a schematic side view showing a reinforcement set for an opening with its edge located at a distance between one beam depth and two beam depth from the column face.
Figure 9:
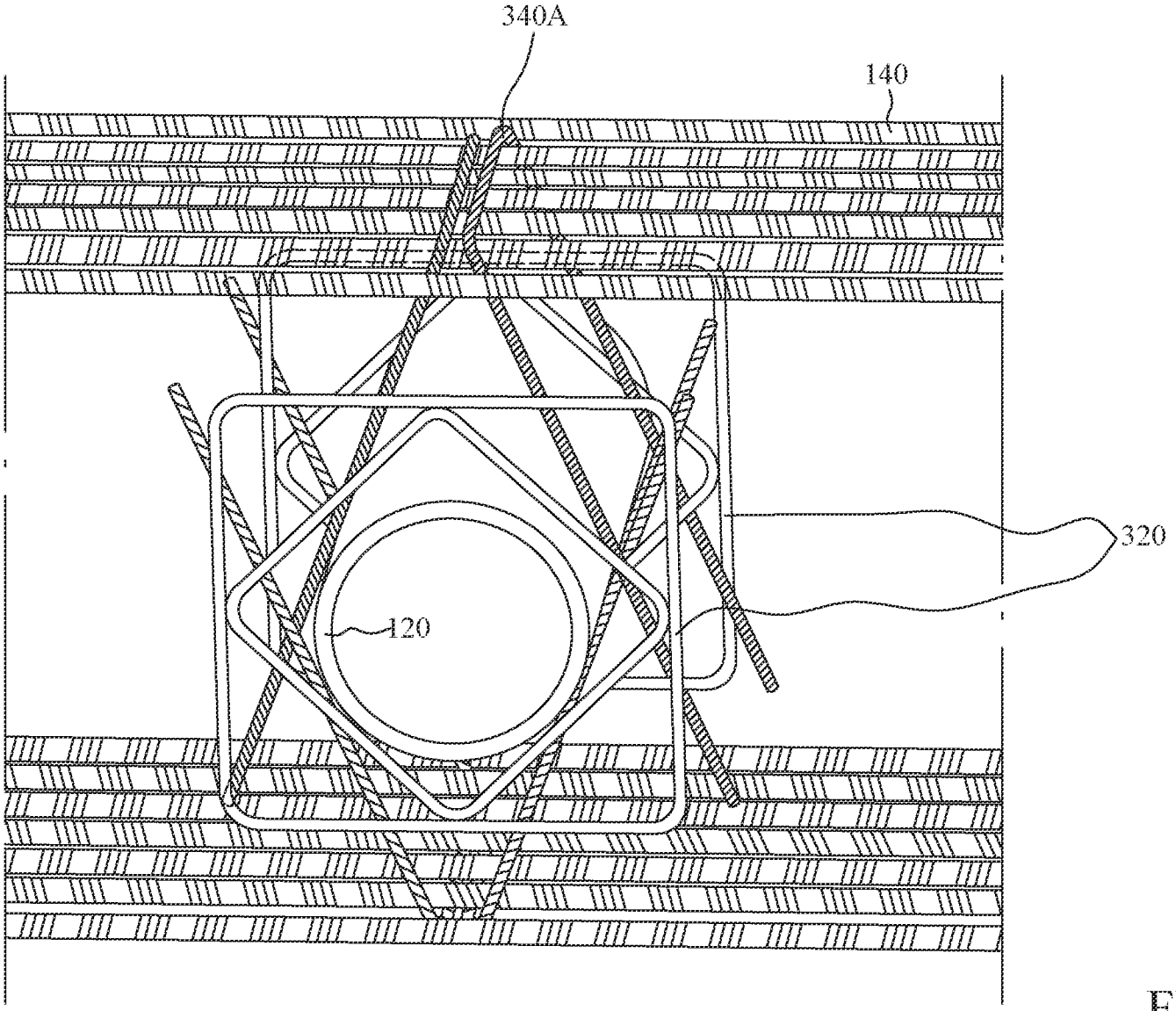
FIG. 9 is a schematic perspective view of the reinforcement set as shown in FIG. 8.

FIG. 8 is a schematic side view showing a reinforcement set 300A for retrofitting the opening 120 in the region bounded by the beam sections located at a distance of one beam depth (1H) and two beam depth (2H) away from the column faces. FIG. 9 is a schematic perspective view of the reinforcement set 300A of FIG. 8. For each opening 120 arranged in the region A2 (1H-2H) of FIG. 5, two double-square hoops 320 are provided to enclose the front and the rear parts of the opening 120, respectively. FIG. 9 shows the second quantity of inclined U-shaped stirrups 340A arranged between the front and rear double-square hoops 320 in region A2. The quantity of the inclined U-shaped stirrups 340A for retrofitting the opening 120 in the region A2 may be less than the quantity of the inclined U-shaped stirrups 340 for retrofitting the opening 110 in the region A1. For the openings 120 in the region A2, test results from cyclic loading show that either using sufficient quantity of the inclined U-shaped stirrups 340 in the present invention to cooperate with the double-square hoops 320 or only using the double-square hoops 320 to retrofit the openings 120 in the region A2 can make the perforated beam 100 achieve the performance equivalent to the beam 100 unperforated in the region A2. Preferably, it is recommended to use the double-square hoops 320 to cooperate with the inclined U-shaped stirrups in the region A2.

In an embodiment, for the openings 130 in the region A3 with its edge located beyond twice the beam depth H (>2H) from the column face, test results from cyclic loading show that only using the double-square hoops 320, namely the quantity of inclined U-shaped stirrups 340 is zero, to retrofit the openings 130 in the region A3 can make the perforated beam 100 achieve the performance equivalent to the beam 100 unperforated in the region A3.

FIG. 10 is a schematic diagram of the double-square hoop 320 according to an embodiment of the present invention. The double-square hoop 320 may be made by one steel bar formed integrally or multiple steel bars through welding. The double-square hoop 320 which is made by one steel bar includes an outer square hoop 322, an inner square hoop 324 and two end portions 326 respectively located at the starting and the ending of the steel bar. The inner square hoop 324 is arranged inside the outer square hoop 322, and both of them are made close to the same plane. The four straight sides of the inner square hoop 324 correspond to the four corners of the outer square hoop 322 respectively, so as to form four triangular regions. In an aspect, the inner square hoop 324 presents a rhombus-shaped configuration relative to the outer square hoop 322. The double-square hoop 320 of the present invention may rely its inner/outer square hoops to better reinforce the periphery of the opening. In an embodiment, the full length of the double-square hoop 320 is 335 cm. The four sides of the outer square hoop 322 are equal in length and each side is 45 cm long, and the adjacent two sides of the outer square hoop 322 are perpendicular to each other. The four sides of the inner square hoop 324 are also of equal length and the adjacent two sides are perpendicular to each other. The end portion 326 is extended by 12 cm. In practice, the bend of the steel bar needs to meet the relevant requirements in the building codes.

Figure 11:
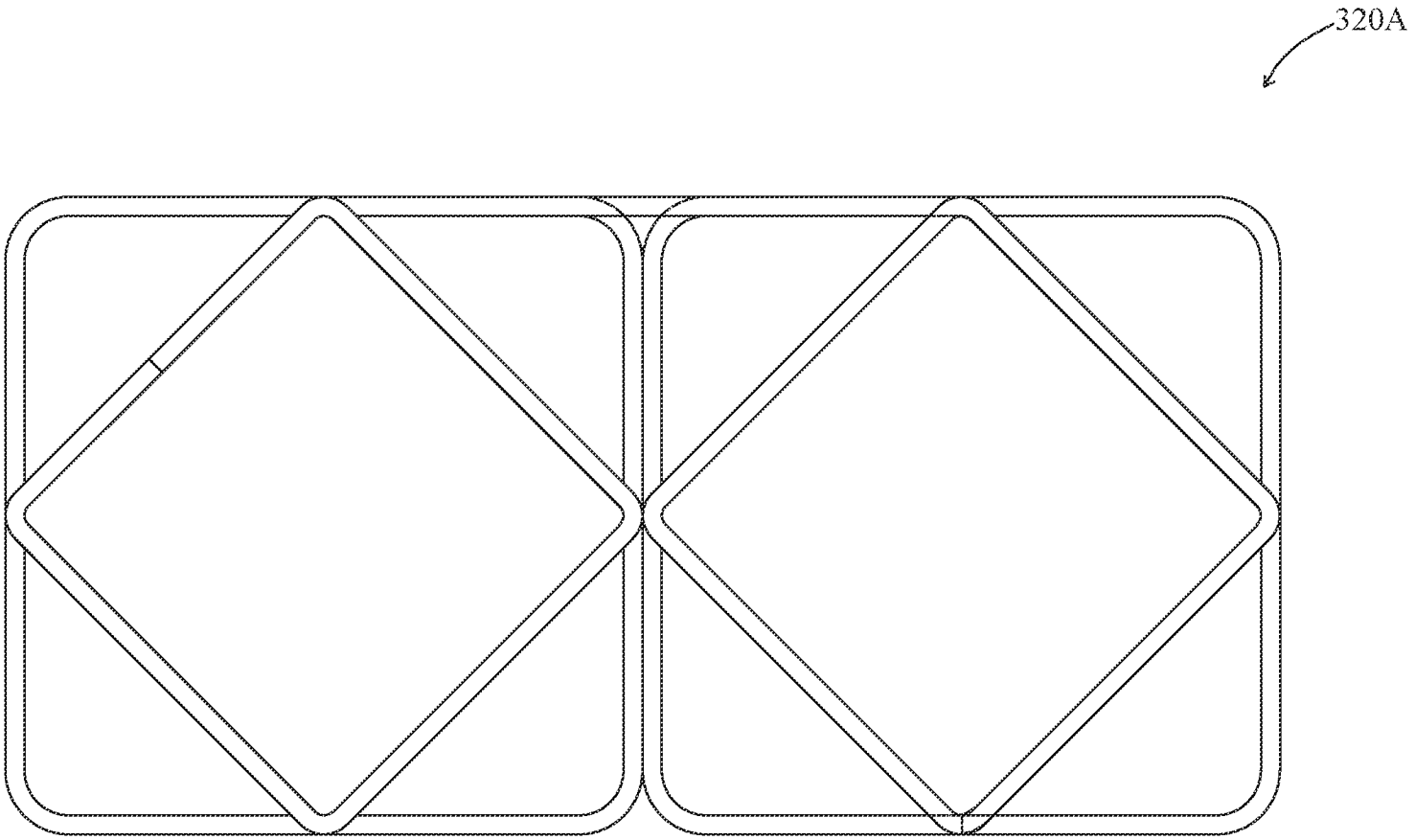
FIG. 11 is a schematic diagram of a hoop with multiple double-square hoop units according to an embodiment of the present invention.

FIG. 11 shows a single hoop 320A comprises two or more continuous double-square hoop units. For the form of each of the double-square units, refer to FIG. 10. These double-square hoop units 320A may be combined by welding or integrally formed for retrofitting multiple openings in the case where the distance between every two adjacent openings is appropriate.

Besides the hoops shown in FIG. 10 and FIG. 11, the present invention provide the hoops having other forms of outer hoop and inner hoop such as the combinations of outer circle with inner circle, outer circle with inner square, outer square with inner circle, outer square with inner hexagon or outer hexagonal with inner rhombus, etc. In other words, the shapes of the outer hoop and the inner hoop can be selected from circles or polygons in a combination of the same shapes or different shapes.

A method for retrofitting the opening of a beam is obtained by summarizing the above embodiments. The method provides a hoop to enclose the opening on the beam, especially the opening in the plastic hinge zone; and provides an inclined stirrup to be cooperated with the hoop to form a reinforcement set. In particular, the present invention evaluates whether the reinforcement set needs to be adjusted according to the different distances between the edge of openings and the column face. For example, the adjusting of the reinforcement set includes adjusting the quantity of double-square hoops, the quantity of inclined U-shaped stirrups, the inclined angle of the inclined U-shaped stirrup, and etc. Accordingly, the present invention may provide a new design criteria, which can be used as a reference for the design of the reinforcement set for retrofitting the beam with openings.

The present inventive discloses a technical concept "forming a reinforcement set of the opening by using a hoop to cooperate with an inclined U-shaped stirrup, and adjusting the reinforcement set according to a location of the opening", that can be fundamentally different from prior art. In case a technology conforms to the above-mentioned technical concept, it should be included in the claim scope of the present invention.

Compared with the traditional supplementary reinforcement, the present invention uses the reinforcement set having simpler configuration of reinforcement set to retrofit the beam with the openings, so as to make the perforated beam reach the performance equivalent to the one without opening.

Accordingly, the present invention have different technical features from the traditional technology, and it is difficult for a person having ordinary skill in the art to come up with the concept of the present invention based on the teaching of the traditional technologies, so the present invention should conform to novelty and non-obviousness.

The foregoing descriptions of the preferred embodiments of the present invention have been provided for the purposes of illustration and explanations. It is not intended to be exclusive or to confine the invention to the precise form or to the disclosed exemplary embodiments. Accordingly, the foregoing descriptions should be regarded as illustrative rather than restrictive. Obviously, many modifications and variations will be apparent to professionals skilled in the art. The embodiments are chosen and described in order to best explain the principles of the invention and its best mode for practical applications, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary to confine the scope defined by the claims to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules on the requirement of an abstract for the purpose of conducting survey on patent documents, and should not be used to interpret or limit the scope or meaning of the claims. Any advantages and benefits described hereto may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A retrofitting method for a beam with an opening, the retrofitting method comprising steps of:

providing a hoop to enclose the opening, wherein the hoop comprises at least one hoop unit including an outer hoop and an inner hoop, wherein the inner hoop is located in an area enclosed by the outer hoop;

providing an inclined stirrup for being cooperated with the hoop to form a reinforcement set; and selectively adjusting the reinforcement set according to a location of an edge of the opening.

2. The method of claim 1, wherein the beam is connected with a column face, and the adjusting the reinforcement set comprises steps of:

dividing the beam into a plurality of regions, wherein each of the regions is suitable to arrange at least one the opening therein; and adjusting the reinforcement set according to a distance between the edge of the opening and the column face, wherein a quantity of the inclined stirrup is reduced as the distance is longer.

3. The method of claim 2, wherein the providing the at least one hoop unit comprises step of:

a shape of the outer hoop and the inner hoop from a group consisting of circle, square and hexagon.

4. The method of claim 3, wherein the shape of the outer hoop and the inner hoop are both square, and the providing the at least one hoop unit comprises step of:

making four sides of the inner hoop cooperate with four corners of the outer hoop to form four triangular regions.

5. The method of claim 3, wherein the providing the inclined stirrup comprises step of:

providing an inclined U-shaped stirrup.

6. The method of claim 5, wherein the inclined U-shaped stirrup includes a plurality of legs, the method further comprising:

making the legs obliquely pass through the beam depth while maintaining a clear cover when passing next to the edge of opening.

7. The method of claim 2, wherein the beam has a beam depth, and the dividing the beam into the plurality of regions comprises steps of:

determining a plurality of boundaries between the plurality of regions according to a specific length extending from the column face toward a mid-span of the beam as well as a range of ratio of the specific length to the beam depth.

8. The method of claim 7, wherein the opening has a diameter, the method further comprising:

determining an inclined angle of the inclined stirrup according to a ratio between the beam depth and the diameter.

9. The method of claim 8, wherein the providing the at least one hoop unit comprises step of:

selecting a shape of the outer hoop and the inner hoop from a group consisting of circle, square and hexagon.

10. The method of claim 9, wherein the shape of the outer hoop and the inner hoop are both square, and the providing the at least one hoop unit comprises step of:

making four sides of the inner hoop cooperate with four corners of the outer hoop to form four triangular regions.

11. The method of claim 9, wherein the providing the inclined stirrup comprises step of:

providing an inclined U-shaped stirrup.

12. The method of claim 11, wherein the inclined U-shaped stirrup includes a plurality of legs, the method further comprising:

making the legs obliquely pass through the beam depth while maintaining a clear cover when passing next to the edge of opening.

13. The method of claim 1, wherein the adjusting the reinforcement set comprises step of:

adjusting a quantity of the inclined stirrup according to the location of the edge of the opening.

14. The method of claim 13, wherein the beam is connected with a column face, and the adjusting the quantity of inclined stirrups comprises step of:

dividing the beam into a plurality of regions, wherein each of the regions is suitable to arrange at least one the opening therein, so as to have a distance from the edge of the opening to the column face; and reducing the quantity of the inclined stirrup as the distance is farther away from the column face.

15. The method of claim 13, wherein the providing the at least one hoop unit comprises steps of:

having a shape of the outer hoop and the inner hoop be both square, wherein the inner hoop has four sides located in an area enclosed by the outer hoop, and the outer hoop has four corners; and making the four sides of the inner hoop cooperate with the four corners of the outer hoop to form four triangular regions.

16. The method of claim 15, wherein the inclined U-shaped stirrup includes a plurality of legs, wherein the providing the inclined stirrup comprises steps of:

providing an inclined U-shaped stirrup; and making the legs obliquely pass through the beam depth while maintaining a clear cover when passing next to the edge of opening.

17. The method of claim 1, wherein the providing the at least one hoop unit comprises step of:

selecting a shape of the outer hoop and the inner hoop from a group consisting of circle, square and hexagon.

18. The method of claim 17, wherein the providing the at least one hoop unit comprises step of:

making four sides of the inner hoop cooperate with four corners of the outer hoop to form four triangular regions when selecting squares to be the shapes of both the outer hoop and the inner hoop.

19. The method of claim 17, wherein the providing the inclined stirrup comprises step of:

providing an inclined U-shaped stirrup.

20. The method of claim 19, wherein the inclined U-shaped stirrup includes a plurality of legs, the method further comprising:

making the legs obliquely pass through the beam depth while maintaining a clear cover when passing next to the edge of opening.

* * * * *